US012693094B2

(12) United States Patent
Eads et al.

(10) Patent No.: US 12,693,094 B2
(45) Date of Patent: Jul. 28, 2026

(54) ADJUSTABLE ARCHERY BOW SIGHT

(71) Applicant: DIALED ARCHERY, LLC, Paynesville, MN (US)

(72) Inventors: Thad J. Eads, Urbana, IN (US); Kyle Davidson, Noblesville, IN (US); Scott A. Bakken, Paynesville, MN (US); Taylor Kollman, Paynesville, MN (US); Jordan Riley, Paynesville, MN (US)

(73) Assignee: DIALED ARCHERY, LLC, Paynesville, MN (US)

( * ) Notice: Subject to any disclaimer, the term of this patent is extended or adjusted under 35 U.S.C. 154(b) by 378 days.

(21) Appl. No.: 18/237,951

(22) Filed: Aug. 25, 2023

(65) Prior Publication Data

US 2024/0068780 A1 Feb. 29, 2024

Related U.S. Application Data

(60) Provisional application No. 63/401,203, filed on Aug. 26, 2022.

(51) Int. Cl.
*F41G 1/467* (2006.01)

(52) U.S. Cl.
CPC ..... *F41G 1/467* (2013.01)

(58) Field of Classification Search
CPC ..... F41G 1/467
See application file for complete search history.

(56) References Cited

U.S. PATENT DOCUMENTS

| | | | | |
|---|---|---|---|---|
| 5,092,052 | A | 3/1992 | Godsey | |
| 5,507,272 | A | 4/1996 | Scantlen | |
| 5,509,402 | A | 4/1996 | Sappington | |
| 5,524,601 | A | 6/1996 | Slates et al. | |
| 5,720,270 | A | 2/1998 | Meicke | |
| 5,878,504 | A * | 3/1999 | Harms | F41G 1/545 33/286 |
| 6,418,633 | B1 | 7/2002 | Rager | |
| 6,430,822 | B1 | 8/2002 | Slates | |
| 6,446,347 | B1 | 9/2002 | Springer | |
| 6,508,005 | B2 | 1/2003 | Springer | |
| 6,802,129 | B1 | 10/2004 | Wirth | |
| 6,892,462 | B2 | 5/2005 | Rager | |
| 7,036,234 | B2 | 5/2006 | Rager | |
| 7,086,161 | B2 | 8/2006 | Ellig et al. | |
| 7,100,292 | B2 | 9/2006 | Afshari | |
| 7,159,325 | B2 | 1/2007 | Rager | |
| D543,603 | S | 5/2007 | Khoshnood | |
| 7,278,216 | B2 | 10/2007 | Grace | |
| 7,290,345 | B2 | 11/2007 | Ellig | |
| 7,343,686 | B2 | 3/2008 | Rager | |
| 7,360,313 | B1 | 4/2008 | Hamm et al. | |
| 7,475,485 | B1 * | 1/2009 | Hamm | F41G 1/473 124/87 |

(Continued)

*Primary Examiner* — Yaritza Guadalupe-Mccall
(74) *Attorney, Agent, or Firm* — PRICE HENEVELD LLP

(57) ABSTRACT

An archery sight with an elevation rail positioned at an angle to the mounting member permits the scope to be sighted for further distances. The scope includes a level positioned at the top of the central opening in the scope housing. A fiber optic cable is also positioned on top of the scope housing to gather the most light. A fiber optic cap can be slid over the fiber optic cable to adjust the amount of light exposure to the fiber optic cable.

19 Claims, 10 Drawing Sheets

(56) References Cited

U.S. PATENT DOCUMENTS

| | | | | |
|---|---|---|---|---|
| 7,549,230 | B2 | 6/2009 | Rager | |
| 7,574,811 | B2 | 8/2009 | Kutzhals et al. | |
| 7,603,784 | B2 | 10/2009 | Erhard | |
| 7,644,503 | B2 * | 1/2010 | Lewis | F41G 1/467 124/87 |
| D632,356 | S | 2/2011 | Jones | |
| 7,900,365 | B1 * | 3/2011 | Johnson | F41G 1/467 33/265 |
| 8,166,662 | B2 | 5/2012 | Williams | |
| 8,171,648 | B2 | 5/2012 | Summers et al. | |
| 8,176,644 | B1 | 5/2012 | Summers et al. | |
| 8,245,409 | B2 | 8/2012 | Varner et al. | |
| 8,448,341 | B2 * | 5/2013 | Haney | F41G 11/003 124/88 |
| 8,677,637 | B2 | 3/2014 | Willis | |
| 8,689,454 | B2 | 4/2014 | Pulkrabek et al. | |
| 8,713,807 | B2 | 5/2014 | LoRocco et al. | |
| 8,819,985 | B1 * | 9/2014 | McCoy | F41G 11/001 42/111 |
| 8,973,277 | B2 | 3/2015 | Pulkrabek et al. | |
| 9,103,632 | B1 | 8/2015 | Larson | |
| 9,285,188 | B1 | 3/2016 | LoRocco et al. | |
| 9,453,709 | B2 * | 9/2016 | Hamm | F41G 11/003 |
| 9,909,839 | B1 * | 3/2018 | Hamm | F41G 1/41 |
| 10,036,612 | B2 * | 7/2018 | Hamm | F41G 1/467 |
| 10,190,851 | B1 * | 1/2019 | Hamm | F41G 1/467 |
| 10,443,983 | B2 | 10/2019 | Hamm et al. | |
| 10,907,933 | B1 * | 2/2021 | Hamm | F41G 1/467 |
| 11,519,694 | B1 * | 12/2022 | Hamm | F41G 1/467 |
| D975,816 | S | 1/2023 | Schuster | |
| 11,698,243 | B2 | 7/2023 | Mason | |
| 12,135,189 | B2 * | 11/2024 | Jones | F41B 5/14 |
| 12,188,748 | B1 * | 1/2025 | Zelenka | F41G 1/345 |
| 2002/0062569 | A1 | 5/2002 | Slates | |
| 2005/0138824 | A1 | 6/2005 | Afshari | |
| 2006/0096150 | A1 | 5/2006 | Graf | |
| 2006/0101657 | A1 | 5/2006 | Khoshnood | |
| 2009/0133272 | A1 * | 5/2009 | Lewis | F41G 1/467 33/265 |
| 2009/0235540 | A1 | 9/2009 | Rager | |
| 2011/0167654 | A1 | 7/2011 | Pulkrabek et al. | |
| 2011/0167655 | A1 | 7/2011 | Pulkrabek et al. | |
| 2015/0135579 | A1 | 5/2015 | Summers et al. | |
| 2020/0033093 | A1 | 1/2020 | Kruger | |
| 2022/0316841 | A1 | 10/2022 | Mason | |
| 2024/0068780 | A1 * | 2/2024 | Eads | F41G 1/467 |
| 2025/0224204 | A1 * | 7/2025 | Springer | F41G 1/467 |

* cited by examiner

ADJUSTABLE ARCHERY BOW SIGHT

CROSS REFERENCE TO RELATED APPLICATION

The present application claims the priority benefits under the provisions of 35 U.S.C. § 119, basing said claim of priority on related U.S. Provisional Application No. 63/401,203 filed Aug. 26, 2022, which is incorporated in its entirety herein by reference.

FIELD OF THE INVENTION

The present invention relates to an adjustable bow sight for an archery bow and the like.

BACKGROUND OF THE INVENTION

Bow sights can be used with bows to help with the accuracy of shots at varying distances. The sights can be adjusted to account for distance to the target, wind, angles, etc. Bow sights typically use a vertical elevation member to move a scope with respect to the peep on the bow for various distances. However, given that the scope is not moved laterally with respect to the peep, the maximum launch angle is limited to the initial spacing of the scope relative to the peep at full draw. In order to increase the launch angle, the entire elevation member and attached scope needs to be moved closer to the peep. This typically requires the removal of fastening members to move a mounting bracket with respect to the scope and the peep to create a secondary set-up. Thus, an archery sight that permits increased launch angles on a single set-up would be advantageous.

SUMMARY OF THE INVENTION

One aspect of the present invention is an archery sight. The archery sight has a mounting member. A dial member is coupled to the mounting member. The dial member has a central opening and a rotatable dial. An elevation rail is movably coupled to the dial member. The elevation rail is positioned at a non-perpendicular angle with respect to the mounting member. The archery sight also includes a scope with an inner opening and at least one sight pin. The scope moves laterally with respect to a peep on the bow when the elevation rail is moved transversely.

Another aspect of the present invention is an adjustable archery sight. The adjustable archery sight has a mounting member. A dial member is coupled to the mounting member. The dial member has a rotatable dial. An elevation rail is coupled to the dial member. The elevation rail is also positioned at a non-perpendicular angle with respect to the mounting member. The archery sight includes scope with an inner opening and at least one sight pin. The scope moves laterally with respect to a peep on the bow when the elevation rail is moved transversely.

Yet another aspect of the present invention is an archery sight. The archery sight has a mounting member. A dial member is coupled to the mounting member. The dial member has a rotatable dial. An elevation rail is coupled to the dial member. The archery sight includes a scope having an inner opening and at least one sight pin. The scope includes a level positioned at the top of the inner opening.

These and other advantages of the invention will be further understood and appreciated by those skilled in the art by reference to the following written description, claims, and dependent drawings.

DETAILED DESCRIPTION OF THE PREFERRED EMBODIMENTS

For purposes of description herein, the terms "outer," "inner," "upper," "lower," "right," "left," "rear," "front," "vertical," "horizontal," and derivatives thereof shall relate to the invention as oriented in the attached drawings. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
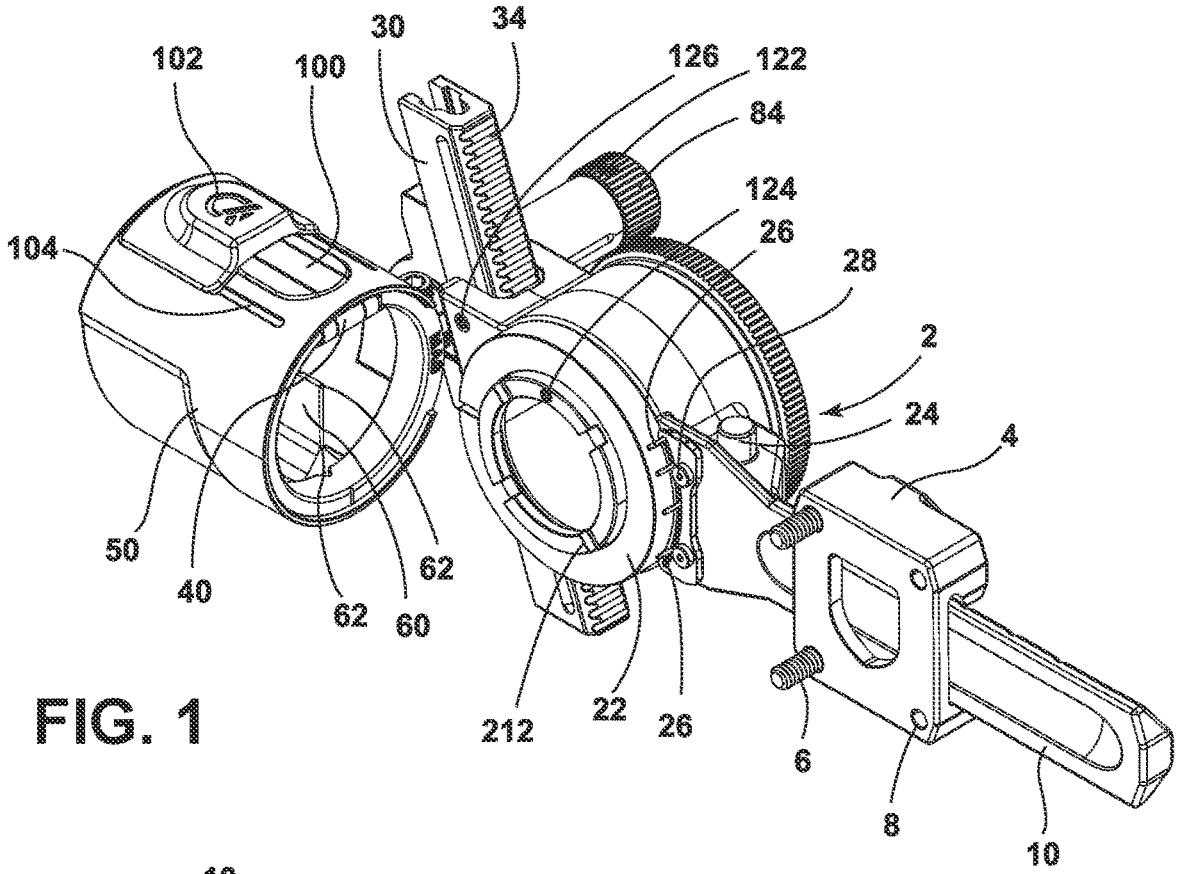
FIG. 1 is a side perspective view of an archery sight.
Figure 2:
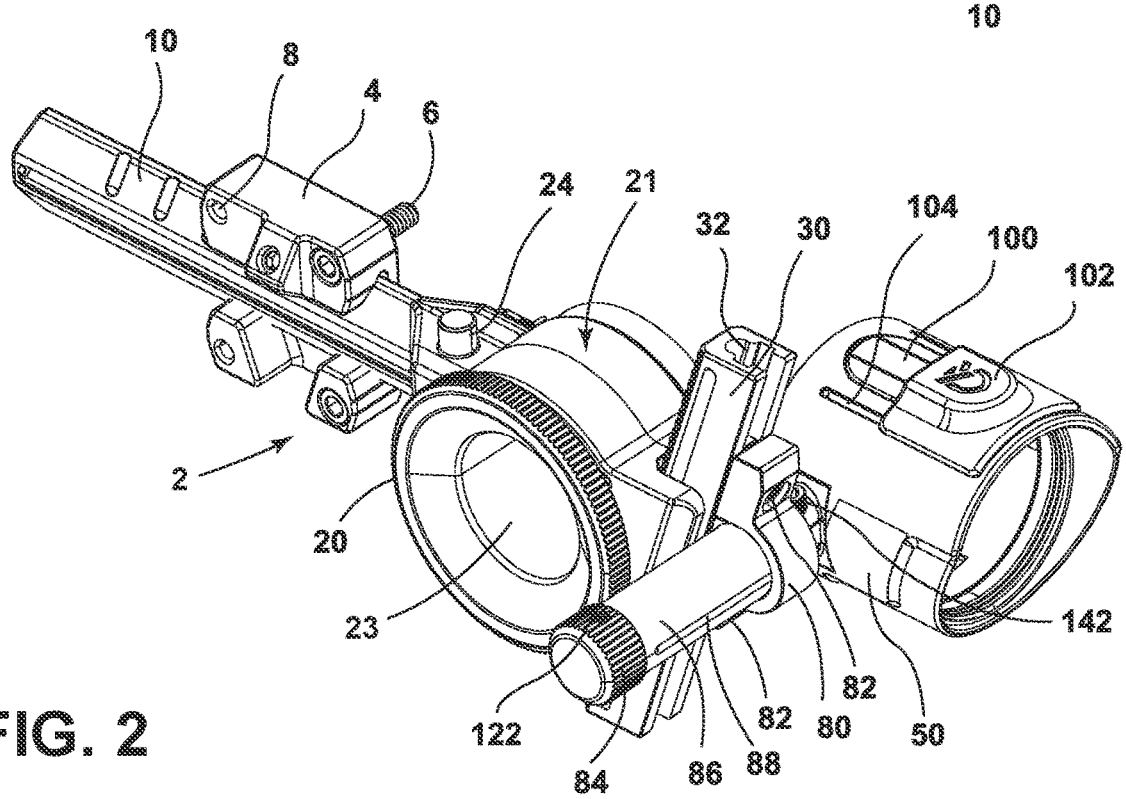
FIG. 2 is an opposite side perspective view of the archery sight shown in FIG. 1.
Figure 3:
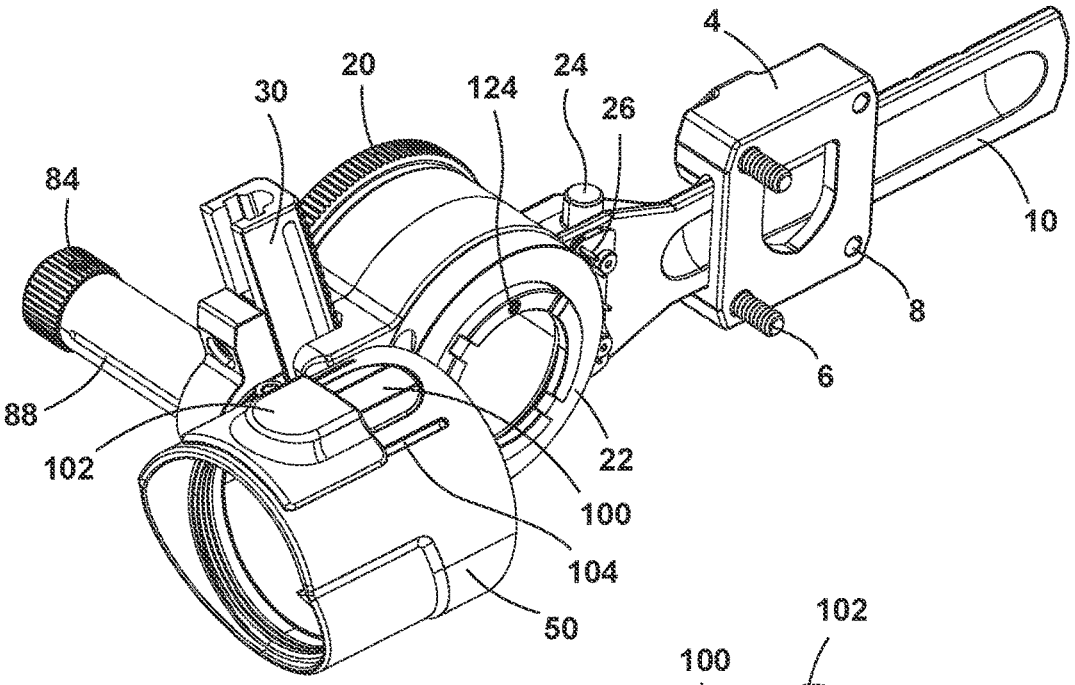
FIG. 3 is a rotated side perspective view of the archery sight shown in FIG. 1.
Figure 4:
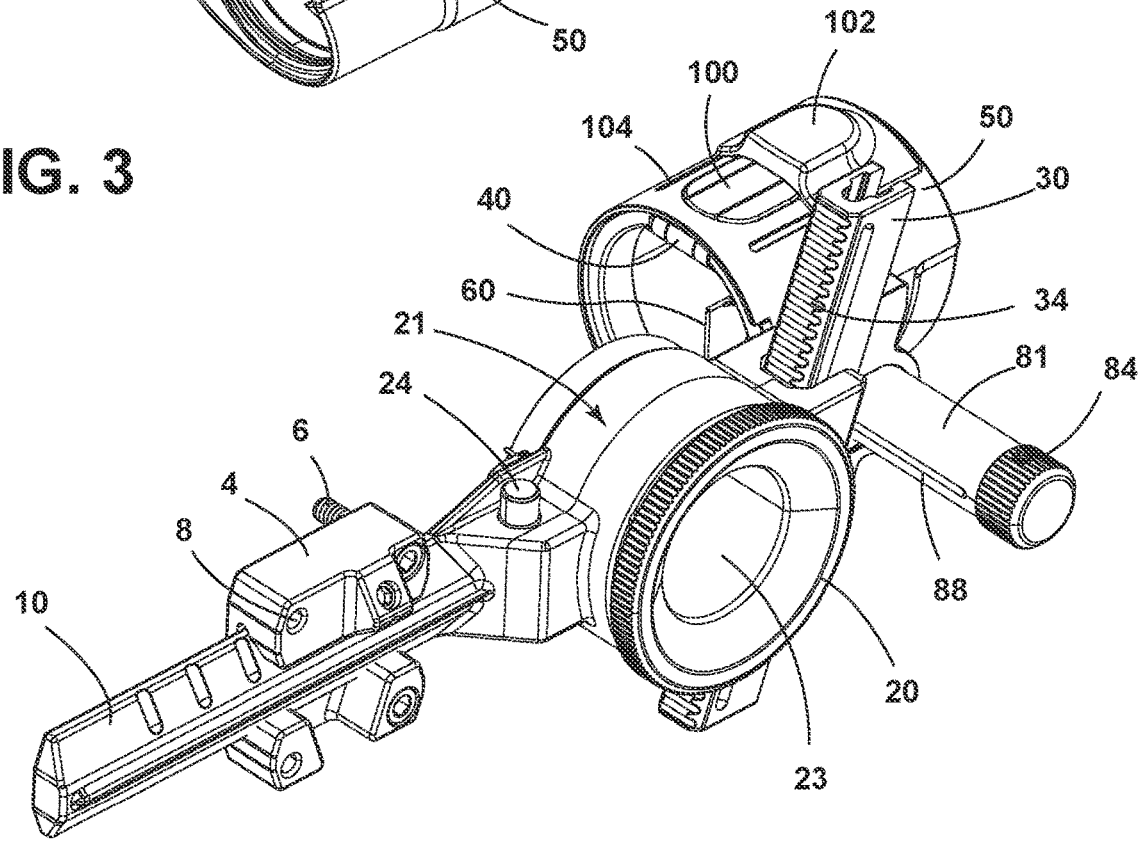
FIG. 4 is a rotated side perspective view of the archery sight shown in FIG. 1.
Figure 5:
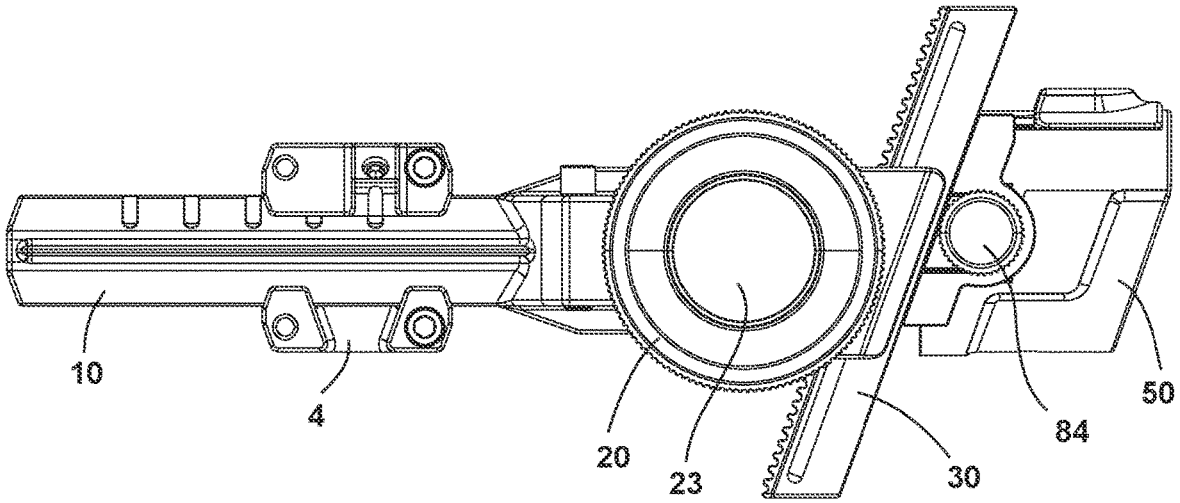
FIG. 5 is a side view of the archery sight shown in FIG. 1.
Figure 6:
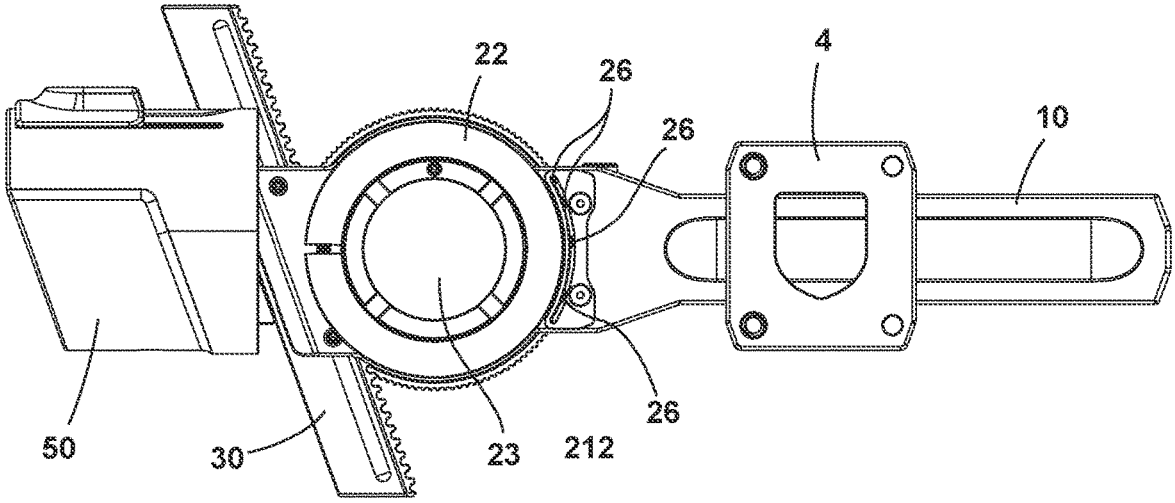
FIG. 6 is a side view of the archery sight shown in FIG. 1.
Figure 7:
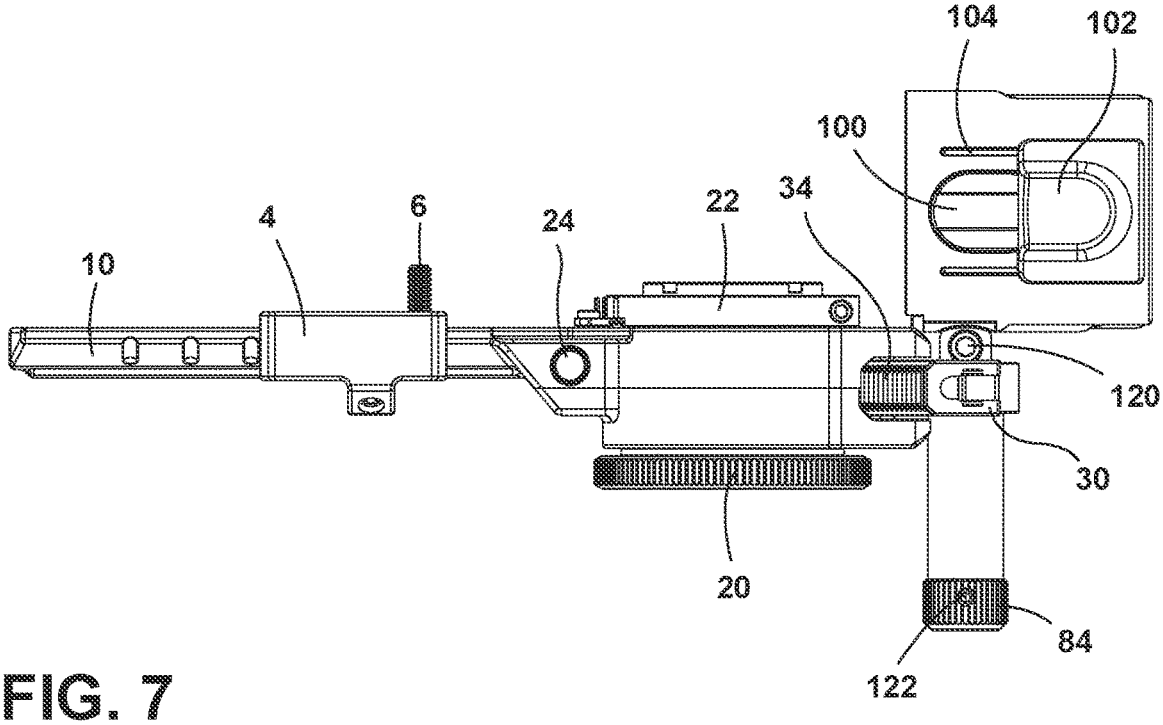
FIG. 7 is a top view of the archery sight shown in FIG. 1.
Figure 8:
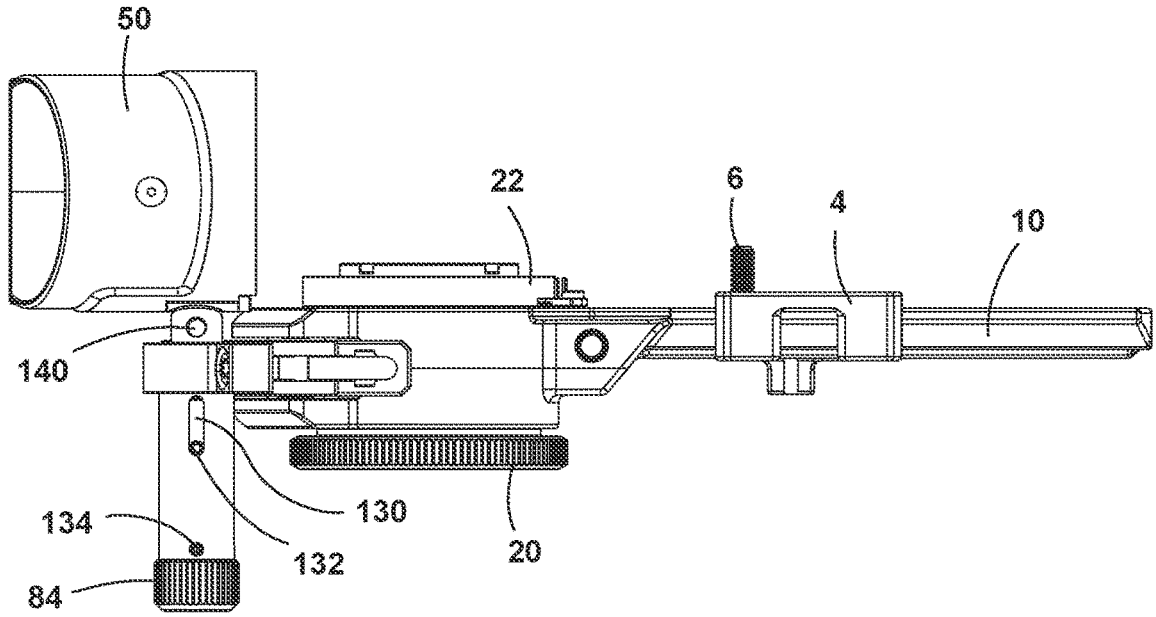
FIG. 8 is a bottom view of the archery sight shown in FIG. 1.
Figure 9:
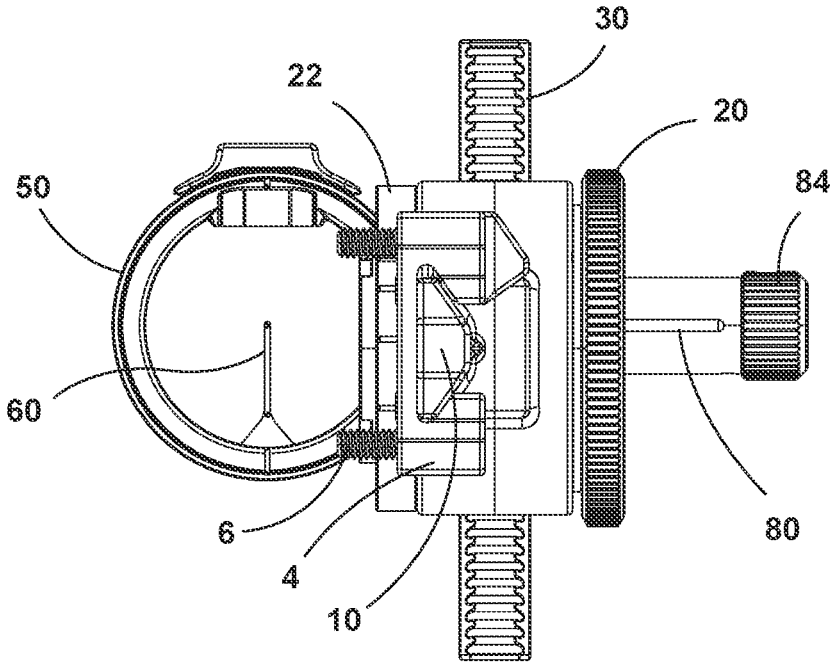
FIG. 9 is a back view of the archery sight shown in FIG. 1.
Figure 10:
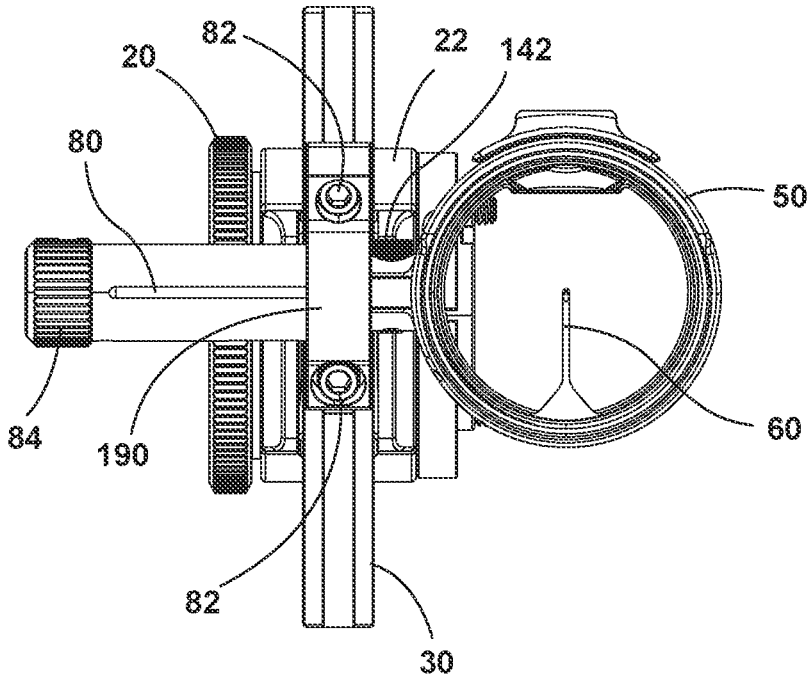
FIG. 10 is a front view of the archery sight shown in FIG. 1.
Figure 11:
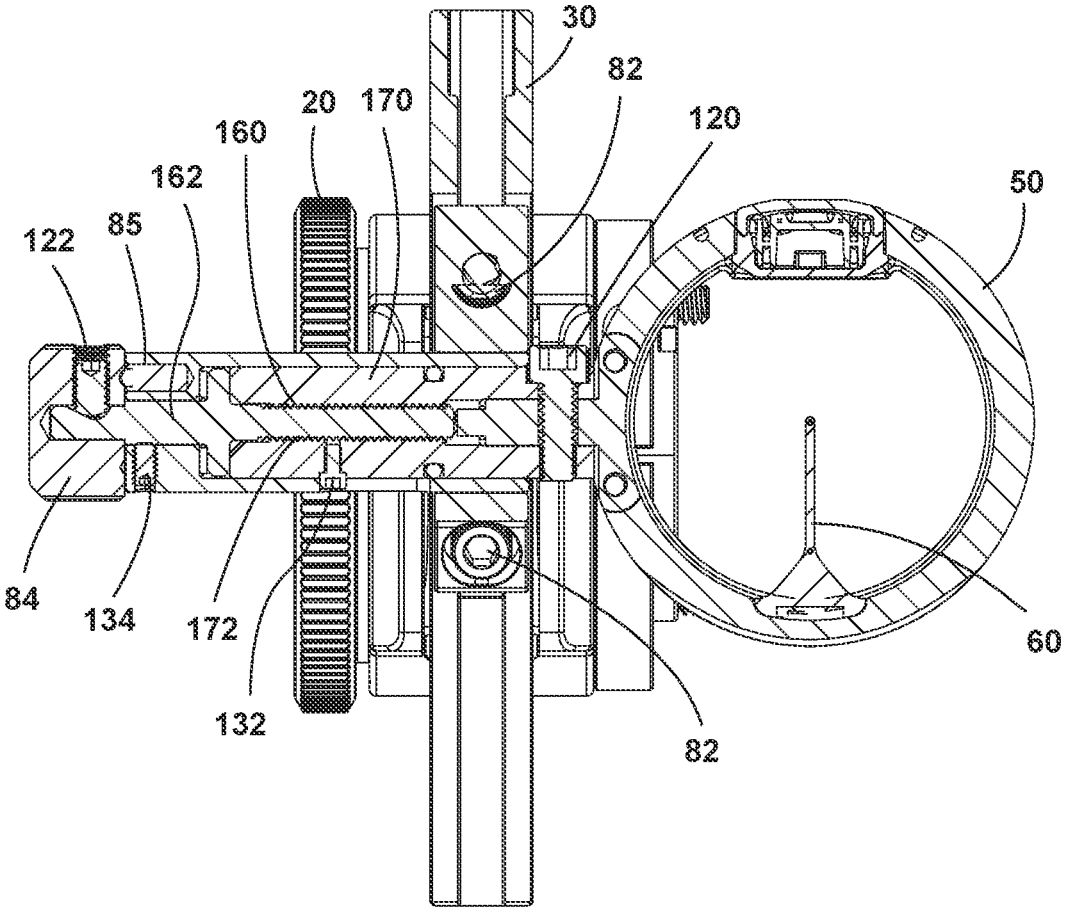
FIG. 11 is a partial front cross-sectional view of the archery sight shown in FIG. 1.

The reference numeral 2 as shown in FIG. 1 is for an archery sight that can be coupled to an archery bow. The archery sight 2 includes a mounting member 10 with a mounting bracket 4. The mounting bracket 4 includes a number of fastener openings 8. Fasteners 6 are inserted through the fastener openings 8 to couple the mounting bracket 4 to an archery bow. In the illustrated embodiment, the two fasteners 6 would be used to couple the mounting bracket 4 to the riser of a bow. The remaining fastener openings 8 can be used to couple a quiver and/or other accessory to the mounting bracket 4. The mounting bracket 4 can be moved forward or backward on the mounting member 10 to adjust for the arm length, draw, or other factors associated with the user of the compound bow. In addition, the archery sight 2 can be used in either a right- or left-hand orientation.

Figure 12:
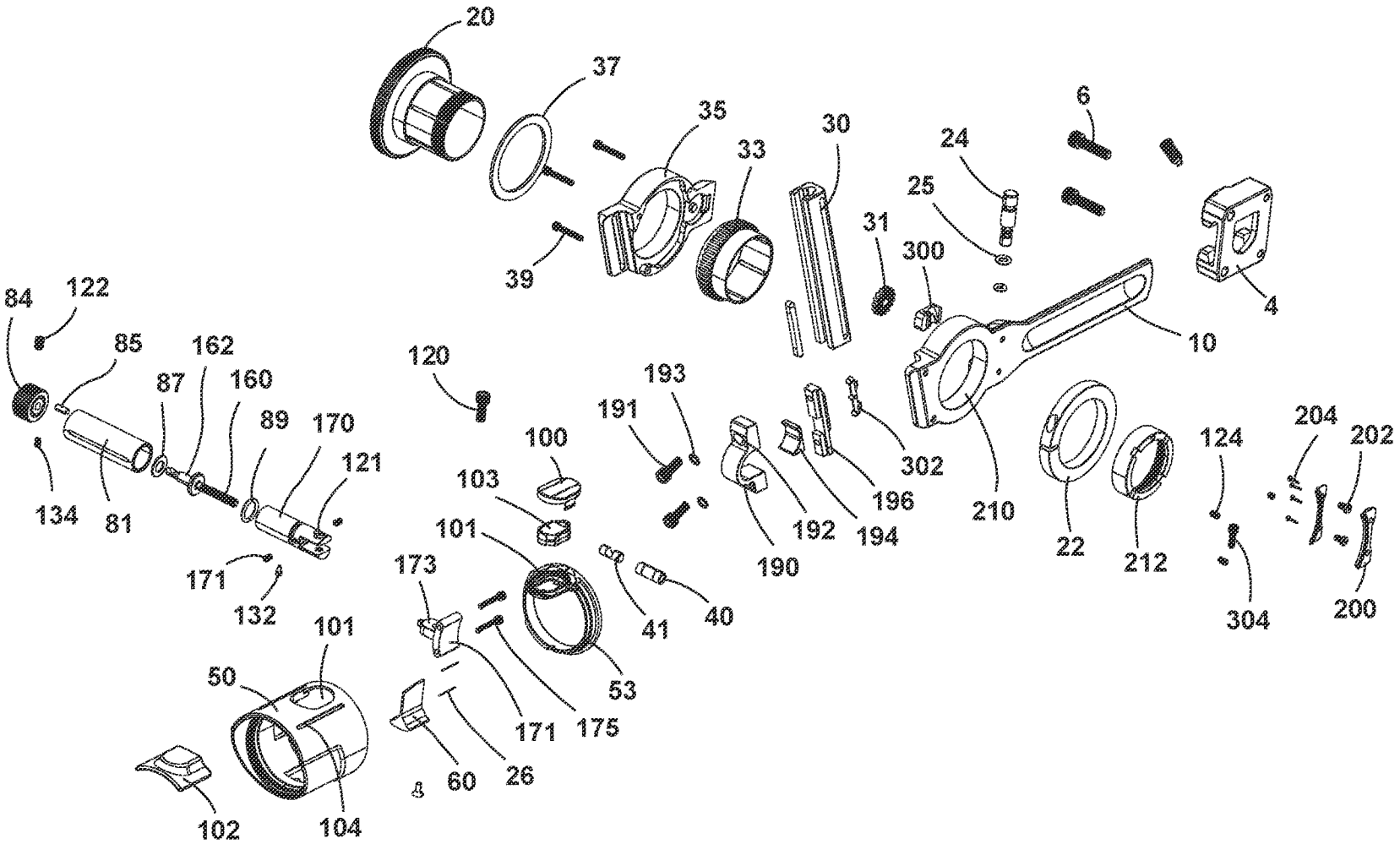
FIG. 12 is a side view of the components of the archery sight shown in FIG. 1.
Figure 13:
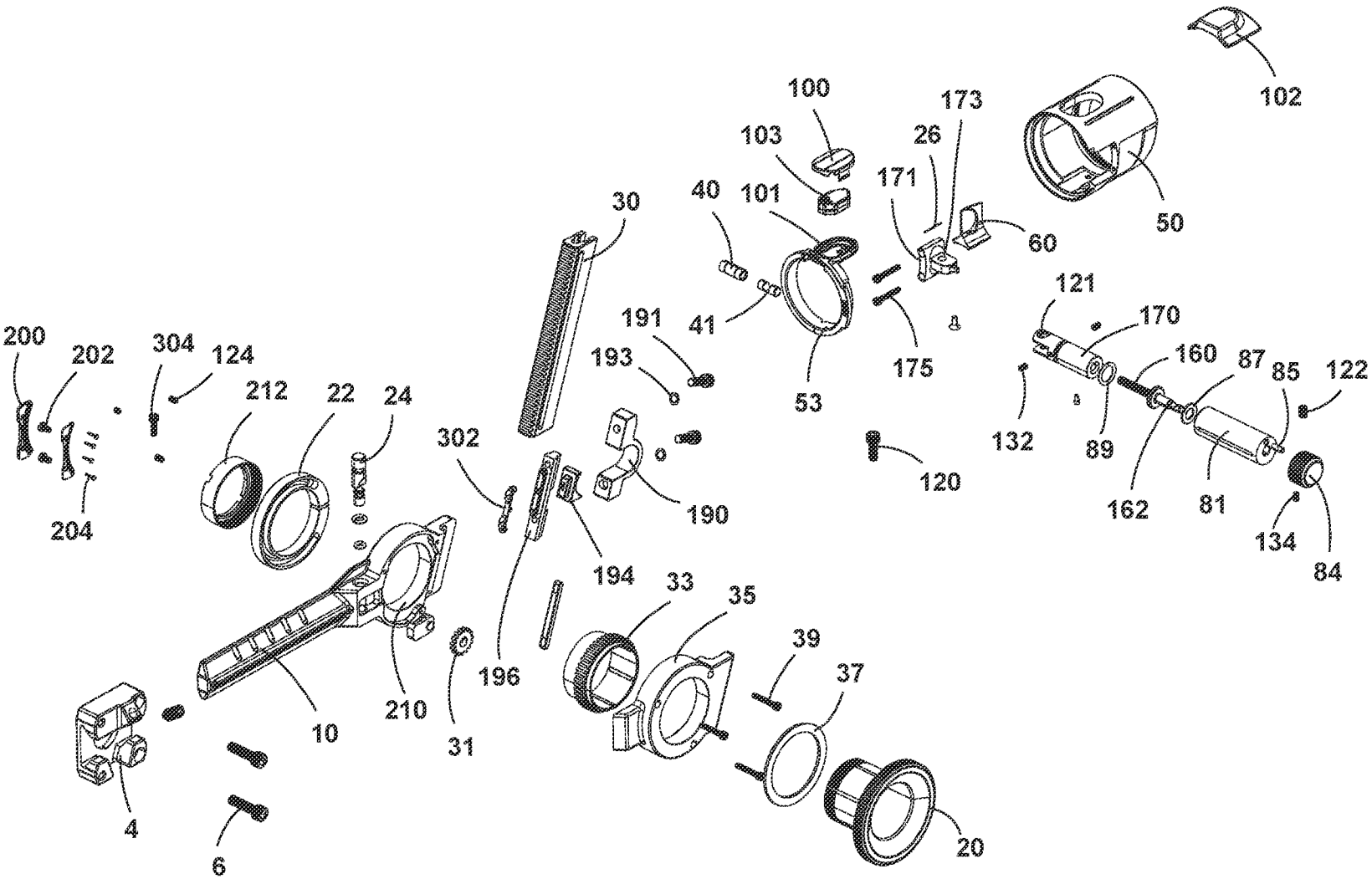
FIG. 13 is an opposite side view of the components of the archery sight shown in FIG. 1.
Figure 14:
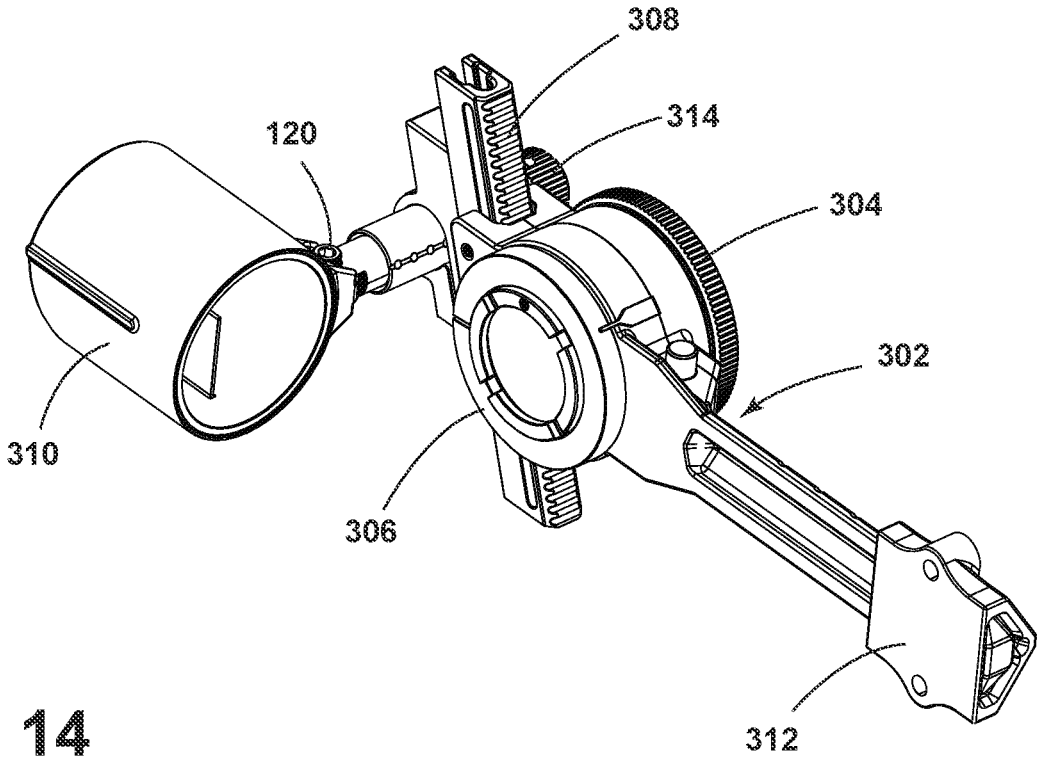
FIG. 14 is a side perspective view of another embodiment of an archery sight.
Figure 15:
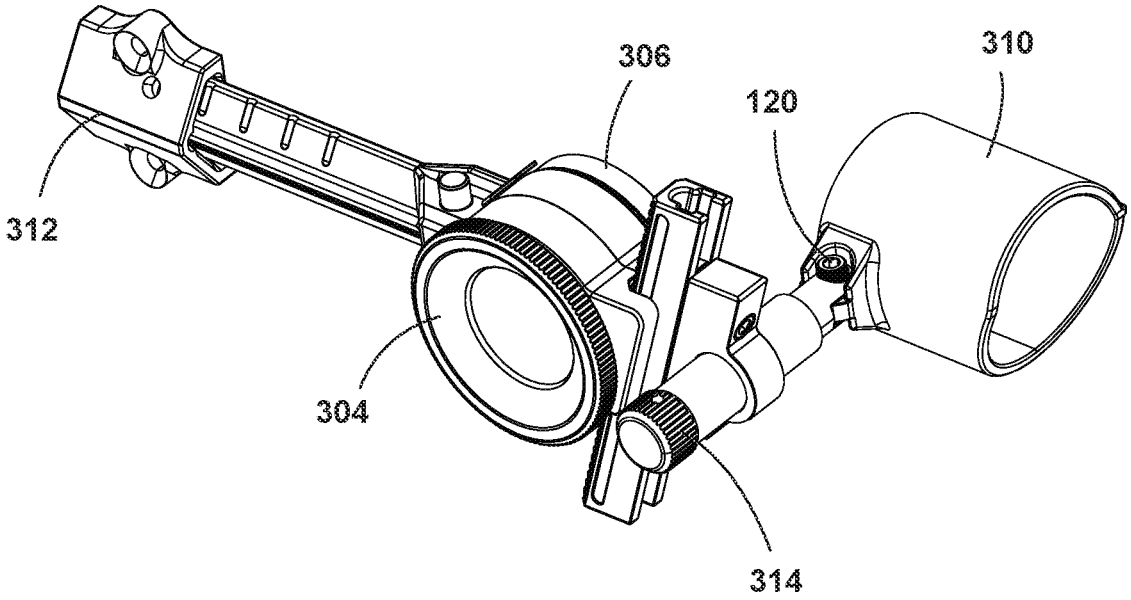
FIG. 15 is an opposite side perspective view of the archery sight shown in FIG. 14.
Figure 16:
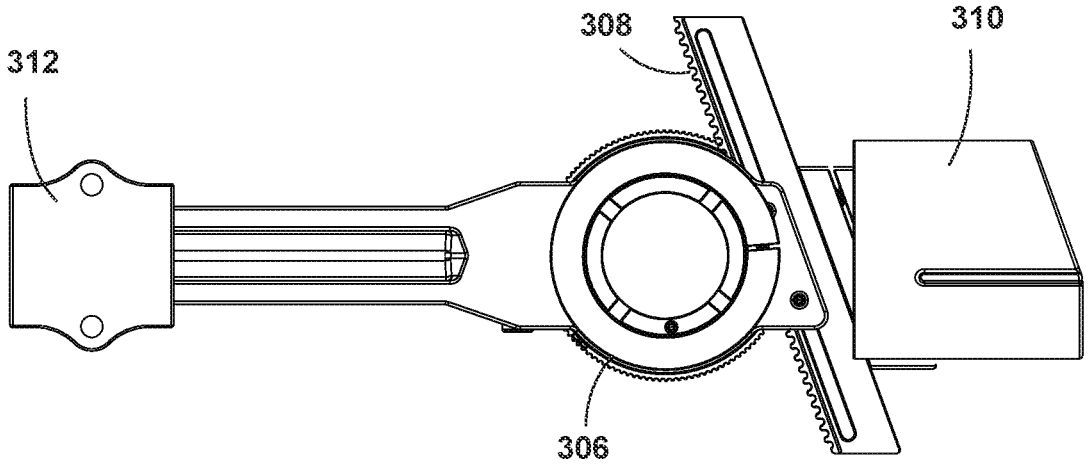
FIG. 16 is a side view of the archery sight shown in FIG. 14.
Figure 17:
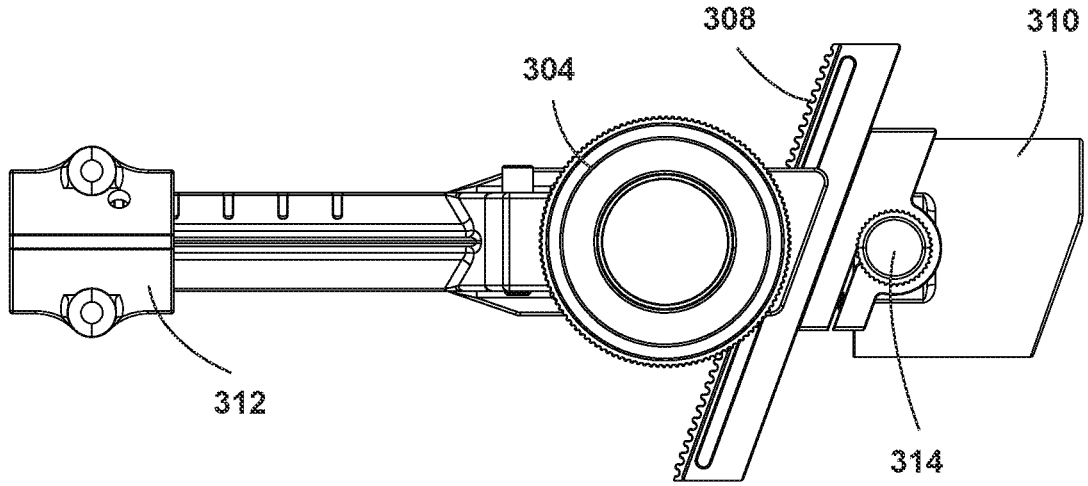
FIG. 17 is an opposite side view of the archery sight shown in FIG. 14.

The mounting member 10 includes a dial opening 210. The dial opening 210 can be formed in the mounting member 10, as shown in the illustrated embodiments, or can be a separate part coupled to the mounting member 10. As illustrated in FIGS. 12 and 13, a dial 20 and a tape ring 22 are coupled to the dial opening 210. A collar 212 can be coupled adjacent to the tape ring 22 and a washer 37 can be coupled adjacent to the dial 20. A cylindrical gear 33 is coupled to the dial 20. The cylindrical gear 33 has a plurality of external teeth, as illustrated in FIGS. 12 and 13. The cylindrical gear 33 rotates when the dial 20 is rotated. In the illustrated embodiment, the dial 20 includes a surface that is received within the cylindrical gear 33. The overlapping surfaces of the dial 20 and the cylindrical gear 33 have corresponding protrusions and slots to translate rotation of the dial 20 to rotation of the cylindrical gear 33.

A brake stop 24 can be used to slow down or stop the rotation of the cylindrical gear 33. The brake stop 24 can be a pin that is received within an opening in the mounting member 10. One or more washers 25 may be used with the brake stop 24. A gear 31 can be positioned between a portion of dial housing 35 and gear shaft 300. The gear shaft 300 includes a post that receives the center opening of gear 31. A similar post can be located on the dial housing 35. The brake stop 24 can engage gear 31 to slow down or stop rotation of the cylindrical gear 33. The dial housing 35 can be coupled to the mounting member 10 by fasteners 39. A portion of the collar 212 can also be coupled to the cylindrical gear 33 to cause the tape ring 22 to rotate as the cylindrical gear 33 and the dial 20 are rotated.

Optional brackets 200 can be coupled to the mounting member 10 adjacent to the tape ring 22. Needles 204 can be removably coupled to the brackets 200 to identify distance markers. The needles 204 can be used to mark out the different distance markers 62 on sight pin 60. Tape with distance markings can be coupled to the exterior surface of the tape ring 22. While the tape ring 22 is illustrated as being positioned opposite the dial 20 on dial assembly 21, the tape ring 22 can be positioned adjacent to the dial on dial assembly 21. As shown in the illustrated embodiments, the dial assembly 21 includes a central opening 23 given that the dial 20, the cylindrical gear 33, the tape ring 22, and the dial housing 35 all have central openings. The coupling of the cylindrical gear 33 to the dial 20 is outside of the central opening 23 thereby protecting that coupling from fluid and debris that could damage the coupling. While the illustrated embodiments illustrate a dial assembly 21 with a cylindrical central opening 23, the dial assembly could be done with a different shaped opening or no through opening at all.

The archery sight 2 includes an elevation rail 30. The elevation rail 30 is positioned at a non-perpendicular angle with respect to the mounting member 10. This angle can be in the range of 5° to 40°. The illustrated embodiments show the angle at about 20°. The angled elevation rail 30 allows the archery sight 2 to be calibrated for longer distances than an elevation rail that is perpendicular to the mounting member 10. When the dial 20 is rotated, the scope housing 50 moves both vertically and laterally because of the angle of the elevation rail 30. When the elevation rail 50 is fully raised, the scope housing 50 will be in its furthest lateral position from the peep on a bow. This is typically where the sight pin 60 is sighted in for a short distance. As the elevation rail 50 is lowered transversely by rotation of the dial 20, the scope housing 50 and sight pin 60 are moved laterally closer to the peep. This closer distance of the scope housing 50 and sight pin 60 to the peep on the bow increases the launch angle of the projectile relative to a scope housing that is coupled to an elevation rail that is perpendicular to the mounting member as the scope housing never moves laterally closer to the peep.

The elevation rail 30 includes a plurality of teeth 34 that engage the teeth on cylindrical gear 33. Thus, the elevation rail 30 can be raised or lowered by rotation of the dial 20. While the illustrated embodiments show an elevation rail 30 with teeth that engage the teeth on a gear 33, other types of couplings can be used to translate the rotation of the dial 20 to the movement of the elevation rail 30, including, but not limited to friction wheels, hydraulic mechanisms, gears, etc. The elevation rail 30 includes an opening 32 that is shaped to receive a bracket retention member 196 that is coupled to a first bracket 194 and a second bracket 190 by fasteners 191 and optional washers 197. The pair of brackets 190, 194 surround the windage tube 81. The windage tube 81 has a groove 88 that receives a corresponding post on one or both of the brackets 190, 194, permitting the windage tube 81 to be moved with respect to the brackets 190, 194 when fasteners 191 are loosened. This movement permits "macro" windage adjustment.

The windage tube 81 includes a central opening that surrounds a threaded post 162 with threaded section 160. The threaded post 162 is coupled to windage dial 84. A dowel 85 can be used to help secure the windage dial 84 to the windage tube 81. In addition, fasteners 122 and 134 can help couple the windage dial 84 and the threaded post 162 to the windage tube 81. The rotation of the windage dial 84 rotates the threaded post 162 to permit "micro" windage adjustment. The threaded portion 160 of the threaded post 162 is in threaded engagement with an extension 170 that is coupled to the scope housing 50. A fastener 120 can be used to couple the scope housing 50 to the extension 170 directly or through intervening members.

The scope housing 50 includes a central opening. A sight pin 60 is coupled to the scope housing 50. The sight pin 60 can include one or more distance markers 62. In the illustrated embodiments, the sight pin 60 is coupled to the bottom of the central opening. However, the sight pin 60 can be positioned on a side of the scope housing 50 and more than one sight pin 60 can be used. A level 40 is positioned on the top of the central opening in scope housing 50 permitting the sight pin 60 to be located on the bottom of the central opening. The positioning of the level 40 also permits the user to see the level while looking through the central opening of the scope housing 50. The level 40 may be positioned using a level housing 41.

A fiber member 103 is coupled to an opening 101 in the top of the scope housing 50. A fiber member cover 100 may be positioned over the fiber member 103. A fiber cap 102 is slidably coupled to openings 104 on the top of the scope housing 50. The fiber cap 102 may be moved to adjust the exposure of the fiber member 103 to light thereby regulating the amount of light passing through the fiber member 103 through fiber cables positioned within the scope housing 50 to the distance markers 62 on sight pin 60. The positioning of the fiber member 103 on top of the scope housing 50 permits increased exposure of the fiber member 103 to natural light compared to it being positioned on other portions of the scope housing 50.

The extension 170 can include fastener openings that receive fasteners 120 to help secure adjustment member 171. Adjustment member 171 includes a tab that is received in the extension 170. The fastener 120 can be received in an opening in the tab that is aligned with the fastener openings in the extension 170. This arrangement also allows the switching out of different scope housings 50.

Set screws can be used to permit and/or limit the rotation of the adjustment member 171 with respect to extension 170, thus permitting another axis of adjustment.

Another embodiment of an archery sight 302 is shown in FIGS. 14-17. That embodiment also uses an elevation rail 308 that is at an angle with respect to the mounting member. A mounting bracket 312 can be used to couple the archery sight 302 to a bow. The dial 304 is used to move the elevation rail 308. The scope housing 310 is coupled to the elevation rail 308. The micro windage adjustment can be done using dial 314. Sight tape 306 can be positioned opposite the dial 304 as illustrated and/or can be positioned adjacent to dial 304.

The components of the archery sight 2, 302 can have a ceramic-based coating to extend the life of the components. In addition, a laser engraved line can be positioned on the top of the dial assembly 21 to act as another yardage indicator.

In the foregoing description, it will be readily appreciated by those skilled in the art that modifications may be made to the invention without departing from the concepts disclosed herein. Such modifications are to be considered as included in the following claims, unless these claims by their language expressly state otherwise.

It will be understood by one having ordinary skill in the art that construction of the present disclosure and other components is not limited to any specific material. Other exemplary embodiments of the disclosure disclosed herein may be formed from a wide variety of materials, unless described otherwise herein.

For purposes of this disclosure, the term "coupled" or "operably coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

For purposes of this disclosure, the term "connected" or "operably connected" (in all of its forms, connect, connecting, connected, etc.) generally means that one component functions with respect to another component, even if there are other components located between the first and second component, and the term "operable" defines a functional relationship between components.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention is claimed as follows:

1. An archery sight comprising:

a mounting member;

a dial member coupled to said mounting member, said dial member having a central opening, and a rotatable dial;

an elevation rail movably coupled to said dial member, said elevation rail positioned at a non-perpendicular angle with respect to said mounting member;

a scope having an inner opening and at least one sight pin; and wherein said scope moves laterally with respect to a peep on a bow when said elevation railed is moved transversely.

2. The archery sight of claim 1, wherein said non-perpendicular angle is approximately 20°.

3. The archery sight of claim 1, wherein said scope includes a level positioned at the top of said inner opening.

4. The archery sight of claim 1, wherein said scope includes a fiber optic cable positioned on the top of said scope, said fiber optic cable coupled to said sight pin.

5. The archery sight of claim 4, including a fiber optic cover that is slidingly engaged with said scope.

6. The archery sight of claim 1, including a tape ring on said dial member.

7. The archery sight of claim 6, wherein said tape ring is positioned adjacent to said rotatable dial on said dial member.

8. The archery sight of claim 6, wherein said tape ring is positioned opposite said rotatable dial on said dial member.

9. The archery sight of claim 1, including at least one indicator needle positioned adjacent to said tape ring.

10. An adjustable archery sight comprising:

a mounting member;

a dial member coupled to said mounting member, said dial member having a rotatable dial;

an elevation rail coupled to said dial member, said elevation rail positioned at a non-perpendicular angle with respect to said mounting member; and a scope having an inner opening and at least one sight pin;

wherein said scope moves laterally with respect to a peep on a bow when said elevation rail is moved transversely.

11. The adjustable archery sight of claim 10, wherein said non-perpendicular angle is approximately 20°.

12. The adjustable archery sight of claim 10, wherein said scope includes a level positioned at the top of said inner opening.

13. The adjustable archery sight of claim 10, wherein said scope includes a fiber optic cable positioned on the top of said scope, said fiber optic cable coupled to said sight pin.

14. The adjustable archery sight of claim 13, including a fiber optic cover that is slidingly engaged with said scope to selectively cover said fiber optic cable.

15. The adjustable archery sight of claim 10, including a tape ring on said dial member.

16. The adjustable archery sight of claim 10, including at least one indicator needle positioned adjacent to said tape ring.

17. The adjustable archery sight of claim 15, wherein said tape ring is positioned adjacent to said rotatable dial on said dial member.

18. An archery sight comprising:

a mounting member;

a dial member coupled to said mounting member, said dial member having a rotatable dial;

an elevation rail coupled to said dial member;

a scope having an inner opening and at least one sight pin;

wherein said scope includes a level positioned at the top of said inner opening-; and wherein said elevation rail is positioned at an approximately 20° angle with respect to said mounting member.

19. The archery sight of claim 18, wherein said scope includes a fiber optic cable positioned on the top of said scope, and a fiber optic cover that is slidingly engaged with said scope.

* * * * *